US008087351B2

(12) United States Patent
Kohl et al.

(10) Patent No.: US 8,087,351 B2
(45) Date of Patent: Jan. 3, 2012

(54) PASSIVE THERMAL INSERT FOR TEMPERATURE-CONTROLLED TRAYS AND FOOD SERVICE COUNTERS

(75) Inventors: Korey V. Kohl, Rogers, MN (US); Robert A. Iverson, Mound, MN (US); Loren Veltrop, Chicago, IL (US); Christopher B. Lyons, Jr., Lagrange Park, IL (US); Donald Van Erden, Wildwood, IL (US)

(73) Assignee: Prince Castle, LLC., Carol Stream, IL (US)

( * ) Notice: Subject to any disclaimer, the term of this patent is extended or adjusted under 35 U.S.C. 154(b) by 411 days.

(21) Appl. No.: 12/478,439

(22) Filed: Jun. 4, 2009

(65) Prior Publication Data

US 2010/0139907 A1 Jun. 10, 2010

Related U.S. Application Data

(63) Continuation-in-part of application No. 12/329,795, filed on Dec. 8, 2008.

(51) Int. Cl.
*A47J 36/00* (2006.01)
*A47J 36/24* (2006.01)

(52) U.S. Cl. ..... 99/403; 99/422; 99/426; 99/448; 99/483

(58) Field of Classification Search ..... 99/403, 99/422, 426, 448, 483
See application file for complete search history.

(56) References Cited

U.S. PATENT DOCUMENTS

| | | | | | |
|---|---|---|---|---|---|
| 664,079 | A * | 12/1900 | Friel | 99/403 |
| 1,786,827 | A * | 12/1930 | Copeman | 220/592.14 |
| 4,005,586 | A * | 2/1977 | Lyons | 62/372 |
| 4,494,654 | A * | 1/1985 | Gunther et al. | 206/562 |
| 4,782,670 | A * | 11/1988 | Long et al. | 62/457.4 |
| 4,852,741 | A * | 8/1989 | Van Benschoten | 206/558 |
| 5,007,552 | A * | 4/1991 | Sage et al. | 220/23.83 |
| 5,073,390 | A * | 12/1991 | Knight et al. | 426/113 |
| 5,207,150 | A * | 5/1993 | Wellman et al. | 99/439 |
| 5,711,210 | A * | 1/1998 | Kaufman | 99/340 |
| 5,720,552 | A * | 2/1998 | Schindlegger | 366/197 |
| 6,269,965 | B1 * | 8/2001 | White et al. | 220/592.18 |
| 6,557,363 | B1 * | 5/2003 | Haasis et al. | 62/258 |
| 2009/0095169 | A1 * | 4/2009 | York | 99/448 |

* cited by examiner

*Primary Examiner* — Sebastiano Passaniti
(74) *Attorney, Agent, or Firm* — Kelly & Krause, LP; Joseph P. Krause

(57) ABSTRACT

Temperature control is provided to food dispensing vessels like condiment dispensers that are too tall to be stored in a shallow, temperature-controlled tray or basin by using inclined or tilted, thermally-conductive tubes placed inside a temperature-controlled tray. Thermal insulating covers improve the thermal efficiency of the tubes.

25 Claims, 14 Drawing Sheets

PASSIVE THERMAL INSERT FOR TEMPERATURE-CONTROLLED TRAYS AND FOOD SERVICE COUNTERS

RELATED APPLICATIONS

This application is a continuation-in-part of U.S. application Ser. No. 12/329,795 filed Dec. 8, 2008.

FIELD OF THE INVENTION

This invention relates to a thermally-insulated canister, usable to vertically extend a heated or refrigerated volume of heated or refrigerated food-serving tray.

BACKGROUND OF THE INVENTION

FIG. 1 shows a prior art food service counter 10 for food storage trays 12 that can keep foods hot or cold. The foods kept in such trays 12 include meats and condiments used to make sandwiches or other food products. FIG. 1 also shows a food condiment dispenser 20 in the trays 12 that is intended to control the temperature of foods kept in the tray.

FIG. 2 is a cross section of a prior art food storage tray 12. In the case of refrigerated trays 12, refrigeration lines 14 absorb heat from the side walls and/or bottom of the tray 12 in order to keep the air inside the tray 12 cold. A vessel 20 embodied as a condiment dispenser is shown in FIG. 2 to be standing upright inside the tray 12. The vessel 20 has a lower portion 24 below the open top 16 of the tray and an upper portion 22 above the open top 16.

It is well known that temperature gradients exist within food-serving trays 12. Room air currents mix with air in the tray 12, which tend to warm the top of a refrigerated tray and cool the top of a heated tray. The air temperature inside and near the top 16 of the tray 12 will almost always be different than the air temperature inside and at the bottom of the tray 12. Food storage trays 12 are therefore less than ideal for storing perishable foods for long periods of time, especially when ambient room air temperatures are high and/or when room air currents are relatively brisk. Upper portions 22 of tall vessels 20 are not refrigerated at all.

Some restaurants, sandwich shops and food services prepare foods that include made-to-order sandwiches, ice cream and pizza. Many such establishments add condiments to their products, examples of which can include but are not limited to, whipped cream, salad dressing, cheeses and mayonnaise. They usually add such condiments using well-known, hand-held dispenser squeeze bottles.

Many condiments need to be kept refrigerated in order to preserve their freshness. Dispensers from which such condiments are dispensed therefore also need to be refrigerated.

While restaurants and food service providers that add perishable condiments to food products know that some condiments need to be kept refrigerated, capital equipment costs, operating expenses and food product preparation time constraints can force many restaurants and food service providers to forego properly refrigerating condiment dispensers 20. Some restaurants and food services have taken to storing hand-held condiment dispensers in a refrigerated tray 12 when the condiment dispensers 20 are not being used in order to keep the dispensers somewhat chilled but nevertheless accessible.

Refrigerated food storage trays 12 used in prior art food service counters 10 are too shallow to properly refrigerate tall, hand-held condiment dispensers 20. Even if the trays 12 were as deep as a condiment dispenser is tall, the temperature gradient inside the tray is nevertheless inadequate to properly chill the top, upper-most part 22 of a tall condiment dispenser 20 because of the temperature gradient that exists in the trays 12. Lowering the nominal tray temperature so that the top portion 22 is kept at or below a proper condiment storage temperature might mean that the bottom portion of a tray goes below 32° F., which would freeze contents at the bottom portion 24 of a dispenser 20. An apparatus and method for assisting the refrigeration of elongated, hand-held dispensers in a temperature-controlled food storage tray 12 would be an improvement over the prior art.

DETAILED DESCRIPTION

Figure 3:
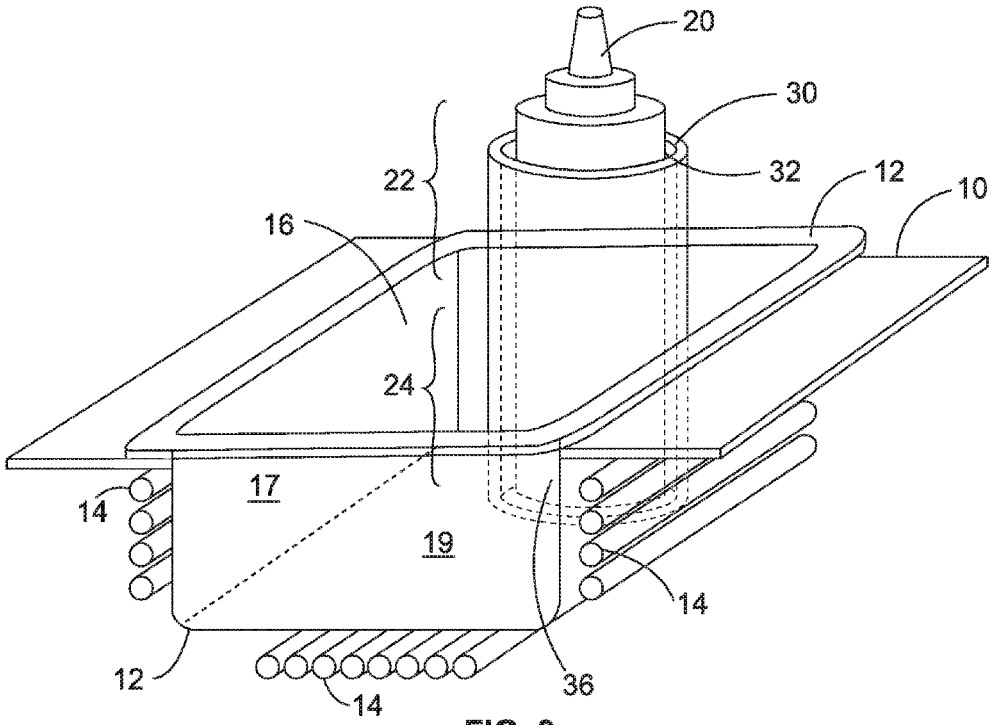
FIG. 3 is a perspective view of a drop-in passive refrigeration canister in a food storage tray.

FIG. 3 shows a perspective view of drop-in passive thermal insert canister 30, in an actively-refrigerated food storage tray 12 in a food service counter 10. As used herein, the term, "canister 30" is used interchangeably with the term, drop-in passive thermal insert 30. For simplicity and clarity purposes, the description of the canister 30 hereafter is with respect to its usage with a cold food storage tray 12. As set forth below, however, the canister 30 could also be used with a hot storage tray.

Figure 1:
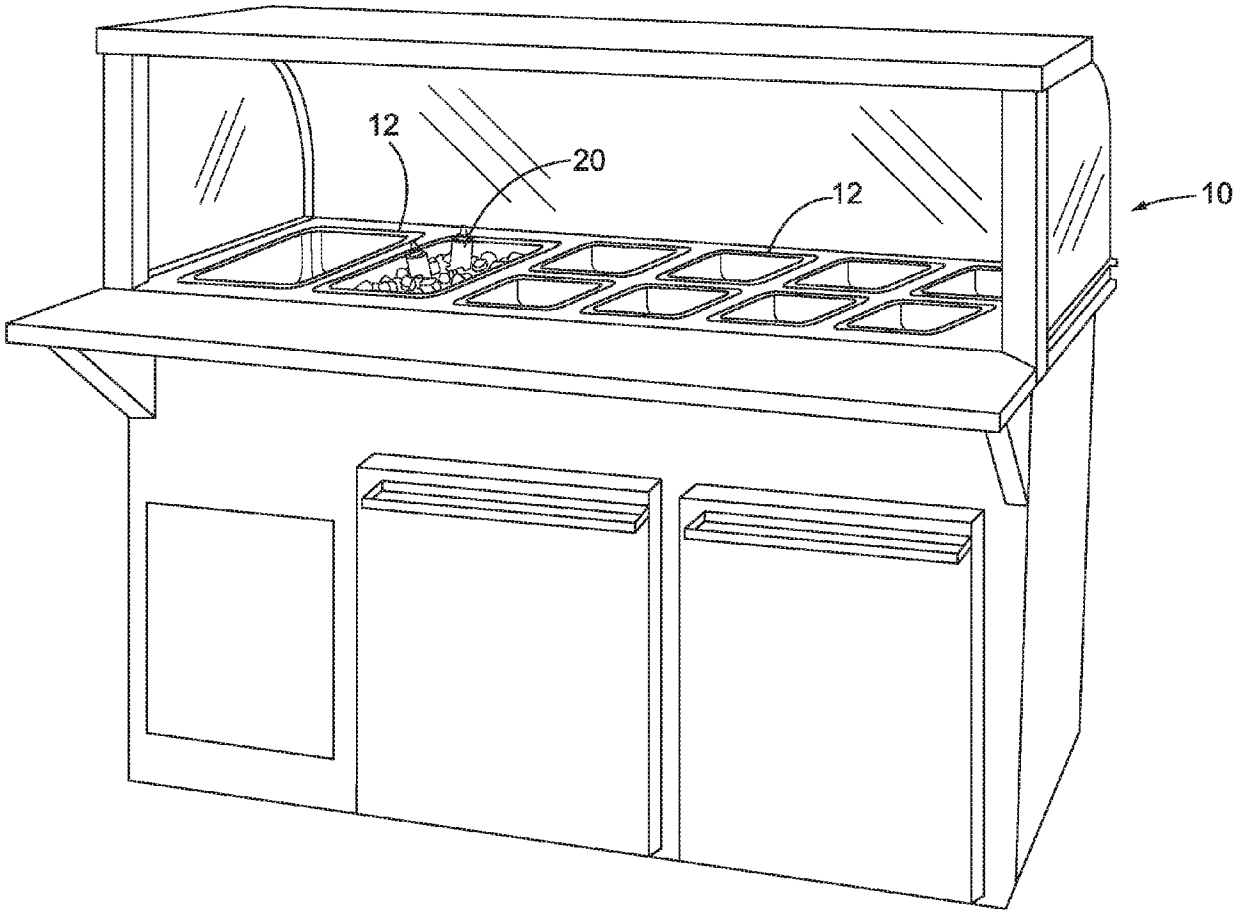
FIG. 1 (PRIOR ART)
FIG. 1 shows a prior art food service counter including several food storage trays.
Figure 2:
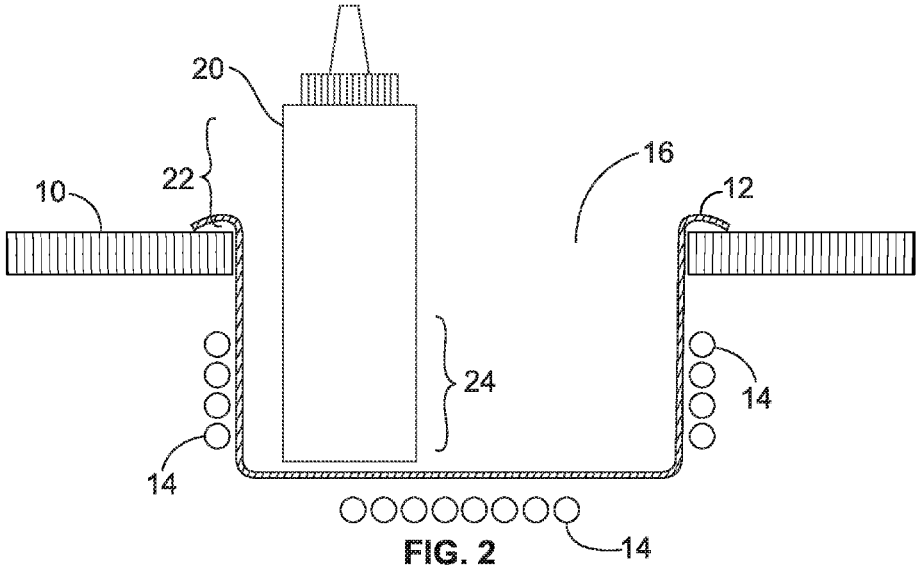
FIG. 2 PRIOR ART
FIG. 2 shows a prior art food storage tray.

The top 16 of a food storage tray 12 is usually left open, as shown in FIGS. 1-3 in order to allow the tray to be filled, but more importantly to allow tray contents to be removed. A consequence of leaving the tray 12 top 16 open is that circulating room air tends to warm the air inside the tray and near the top 16 of the tray 12. Room air and convective currents thus tend to create a temperature gradient inside the tray 12.

FIG. 3 also shows a first example of a drop-in, passive thermal insert canister, configured to passively refrigerate a tall, upright, condiment canister 30. The drop-in passive canister 30 is preferably embodied as a tube, oriented or "standing" upright in the tray 12 such that the center axis or length dimension of the tube is orthogonal to the bottom 19 of the tray 12.

The canister 30 has a height that is greater than the depth of the tray 12, the tray depth being considered herein to be equal to, or substantially equal to, the distance between the open top 16 of the tray 12 and the bottom 19 of the tray. As set forth below, the portion of the canister 30 above the top 16 of the tray 12 allows the canister 30 to provide passive temperature control, i.e., refrigeration or heating, to the upper portion 22 of the vessel 20 stored inside the tube, the upper portion 22 of the vessel 20 being considered to be the portion of the vessel above the top 16 of the tray 12.

The tube forming the canister 30 shown in the figures has an open interior that defines an open volume that accepts a vessel 20, such as the aforementioned hand-held condiment dispenser. (Vessel and condiment dispenser are hereafter used interchangeably.) The height of the canister 30 is greater than the depth of the tray 11, but less than the height of a vessel 20 to be passively refrigerated in order to allow the vessel 20 to be grasped for removal from the canister 30.

Figure 4:
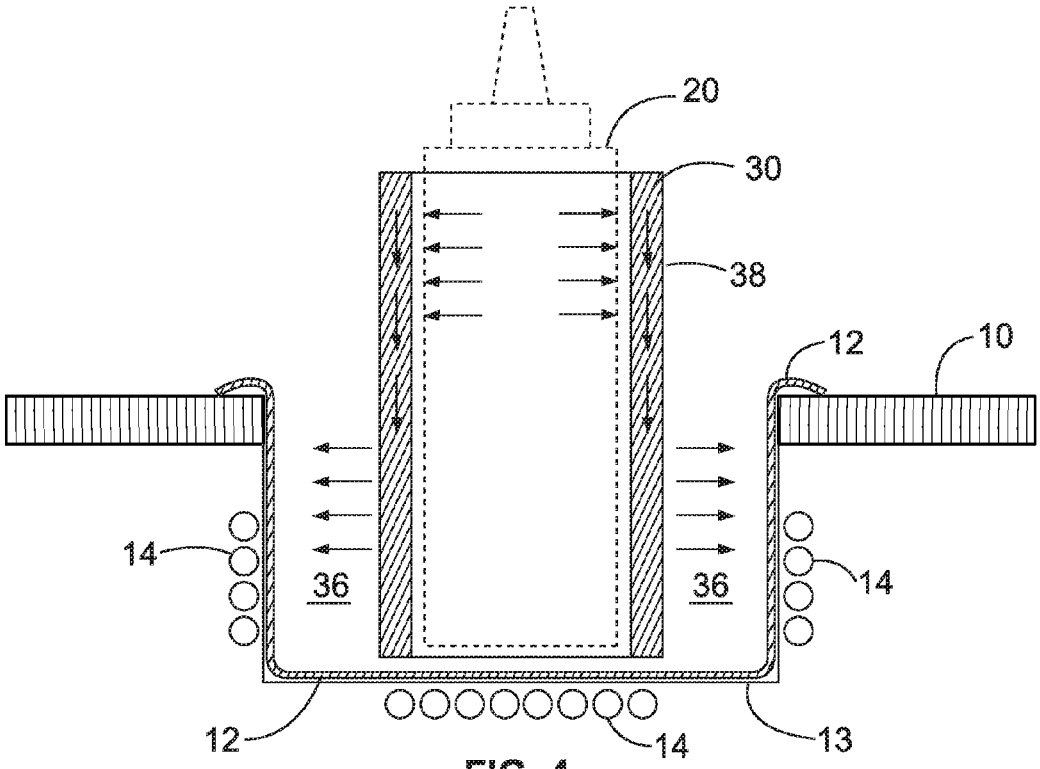
FIG. 4 is a cross section of a drop-in passive refrigeration canister, an included passively refrigerated vessel 20 and a refrigerated food storage tray wherein heat flow is depicted by arrows.

FIG. 4 is a cross sectional view of the canister 30 and a refrigerated tray 12. Phantom lines show a condiment dispenser 20 inside the canister 30. The arrows in FIG. 4 indicate heat flow direction for a refrigerated, i.e., cold food storage tray 12. The direction of the arrows shown in FIG. 4 would be reversed from a hot food storage tray.

As can be seen in FIG. 4, the drop-in, passive refrigeration canister 30 provides a heat-absorbing body to vessel 20, which provides passive refrigeration by absorbing heat radiated from the vessel 20 and re-radiating the vessel-originated heat into the tray 12. When the canister 30 is installed into the tray 12, latent heat in the lower portion 36 of the canister 30 radiates from the canister 30 into cold air in the tray 12, including in particular the lowest and coldest portion of the tray 12, i.e., the bottom surface 19. In some embodiments, the canister 30 does not rest on the bottom 19 of the tray 12, but is instead suspended from either the counter 10 top or tray side walls. In other embodiments wherein the canister 30 rests or "sits" on the bottom 19 of the tray 12, heat in the lower portion 36 of the canister 30 is also conducted from the canister 30 into the bottom 19 of the tray.

Radiating and/or conducting heat from the lower portion 36 of the canister 30 into the tray 12 causes the temperature of lower portion 36 of the canister 30 to drop, relative to the temperature of the upper portions 38 of the canister 30. Because the canister 30 is constructed of thermally-conductive material, latent heat in the initially warmer upper portion 38 of the canister 30 is conducted downward, through the canister material to the colder, lower portion 36 of the canister 30 where it, too, is radiated and/or conducted into the tray 12.

When heat is conducted from the upper portion 38 of the canister 30 to the lower portion 36, the temperature of the upper portion 38 of the canister 30 will decrease, relative to its surroundings. A decreased temperature of the upper portion 38 of the canister 30 allows the upper portion 38 of the canister to absorb heat radiated from the upper portion of a relatively warmer vessel 20 placed inside the canister 30. The canister 30 is thus able to absorb heat radiated from a vessel 20 inside the canister and re-radiate (as well as conduct) the heat from the vessel 20 into the tray 12, so long as the temperature of a vessel inside the canister 20 is greater than the temperature of the canister itself. Heat radiated from a vessel 20 inside the canister 30, including in particular heat radiated from a vessel at elevations of the vessel that are above the top 16 of the tray 12, is thus captured by the canister 30, conducted downward through the canister 30 and radiated and/or conducted into the tray 12 for absorption by a refrigeration device, not shown. The structure, geometry and material of the canister 30 thus provide a passively temperature-controlled space above the top 16 of the tray 12 and above the top of a food service counter 10 in which a tray might be installed and operated with.

The canister 30 shown in the figures is embodied as a cylindrical, aluminum tube. It has an open top 32 to receive a cylindrical, hand-held condiment dispenser 20. In an alternate embodiment, the opposite end of the cylinder, i.e., the bottom 39 of the tube, is closed off to form a flat, thermally-conductive bottom that can either rest on or be suspended above the bottom 19 of the tray 12. The increased area of a flat, closed-off bottom enhances heat conduction between the canister 30 and the tray 19, but requires additional material and hence additional fabrication cost. A closed-off bottom can also make cleaning the canister 30 more difficult.

The canister 30 has an interior cross sectional shape that preferably conforms to and which is just slightly larger than the exterior shape or cross section of a vessel 20, the temperature of which is to be passively controlled. Matching the interior shape and size of the canister 30 to the exterior shape and size of a vessel to be passively refrigerated improves passive temperature control by tightening the thermal coupling between the two bodies. Another embodiment uses a canister 30 having an inside diameter that allows the exterior surface of the vessel 20 to physically contact the insider surface of the canister and remain in physical contact therewith in order to facilitate conductive heat transfer between the vessel 20 and the canister 30. Alternate embodiments of the canister 30 can have non-circular cross sections that can be square, rectangular, oval or elliptical, triangular or any irregular closed polygon, but as set forth above, the cross section of the canister 30 preferably matches, and is only slightly greater than the cross section of a vessel to be passively refrigerated.

Figure 5:
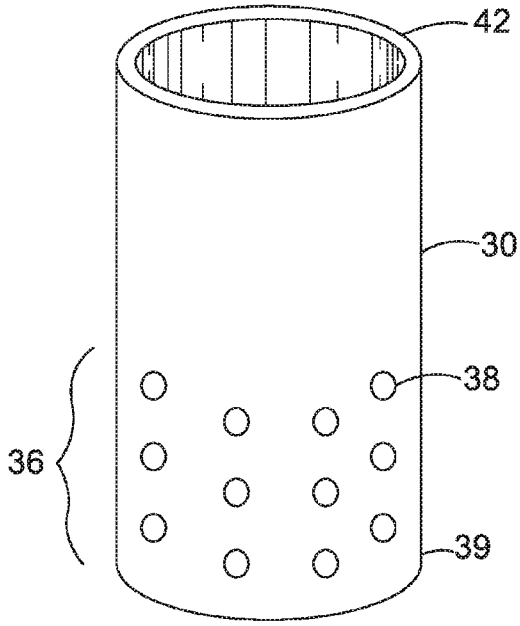
FIG. 5 is a perspective view of an alternate embodiment of a drop-in passive refrigeration canister.

FIG. 5 depicts an embodiment of a canister 30, the lower portion 36 of which is optionally perforated with holes 37 to facilitate air movement through the interior of the canister 30. Providing holes 37 in the lower portion 36 but not in the upper portion allows conditioned air (warm or cold air) in a food storage tray 12 to move through the lower portion 36 of the interior of the canister 30, which improves convective heat transfer between the canister 30, a vessel 20 inside the canister 30 and the tray 12. Not providing holes in the upper portion prevents ambient air from circulating into the conditioned, upper portions of the interior of the canister 30. When holes 37 are provided to a canister, they are preferably formed from the bottom 39 of the tube to a level corresponding to the top 16 of the tray 12 so that the holes 37 are located within the tray 12.

Figure 6A:
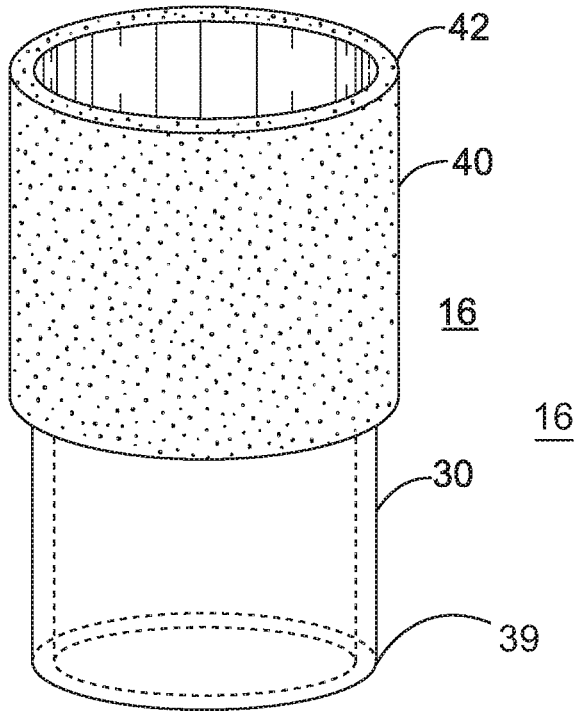
FIG. 6A is a perspective view of another embodiment of a drop-in passive refrigeration canister with an insulation layer.

FIG. 6A shows another embodiment of a drop-in passive thermal insert 30 wherein the canister 30 is provided with a relatively thin thermal insulation layer 40 around the outside of the upper portion of the tube forming the canister 30. The insulation layer 40 preferably covers only the portion of the canister 30 that extends above the top 16 of a tray 12 in order to reduce heat transfer between portions of the canister above the top 16 of the tray 12 and ambient room air. In FIG. 6A, the insulation layer 40 has a uniform outside diameter and extends from the top 42 of the tube down to the level of the tube that would be adjacent the top 16 of the tray 12, when the canister 30 placed into a tray 12. The lower portion of the canister 30, i.e., the portion below the top of the tray 12 down to the bottom 39 of the tube is not insulated, which creates a discontinuity in the outside surface of the canister 30 where the insulation layer ends.

Figure 6B:
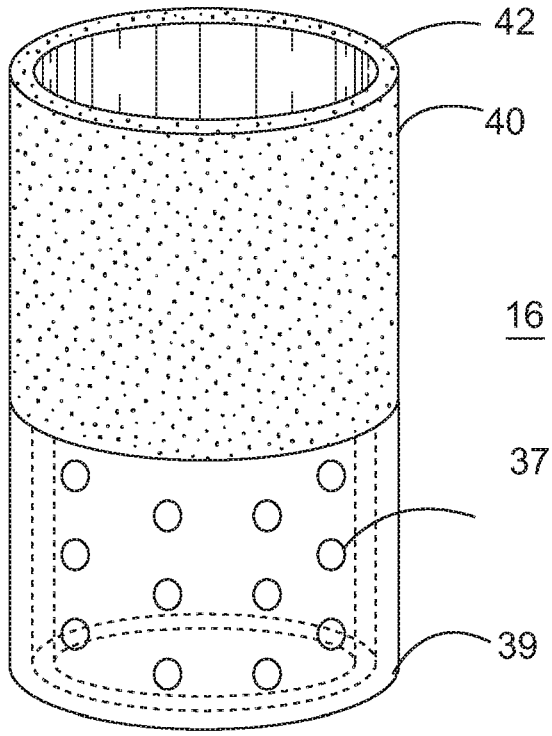
FIG. 6B is a perspective view of an alternate embodiment of drop-in passive refrigeration canister with an insulation layer.

In FIG. 6B, the wall thickness of the tube, the tube diameter or both are increased from the bottom 39 of the tube up to the elevation where the insulation layer 40 ends so that exterior of the canister 30 does not have an outside diameter discontinuity shown in FIG. 6A located where the insulation layer ends. Holes 37 are optionally formed into the lower portion of the embodiment of FIG. 6A or the embodiment of FIG. 6B in order to facilitate convective heat transfer.

Figure 7:
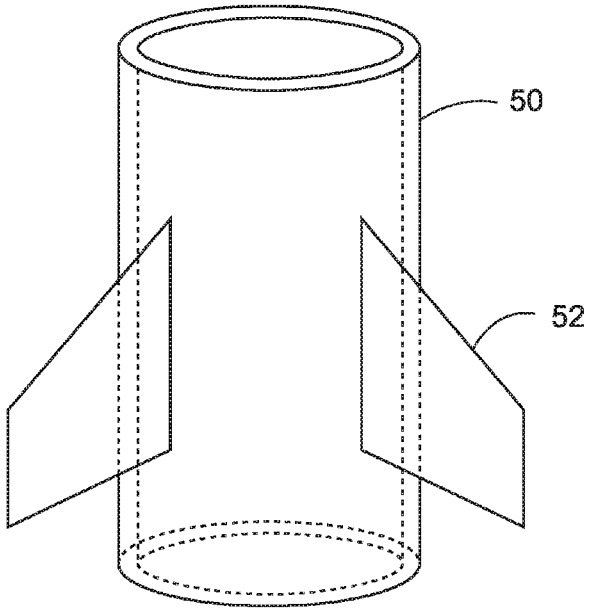
FIG. 7 is a perspective view of an alternate embodiment of a drop-in passive refrigeration canister.

FIG. 7 shows another alternate embodiment of a passive canister 30 wherein the passive canister 30 is provided with thermally-conductive fins 52 that extend outwardly from the exterior surface of the passive canister 30. The thermally-conductive fins 52 increase the surface area of thermally-conductive material that can radiate heat from the canister 30 into cold air inside a refrigerated tray 12. The fins 52 thus increase the rate at which heat radiated from a vessel 20 can be absorbed by the passive canister 30 and dissipated/radiated into cold air in the tray 12.

Figure 8:
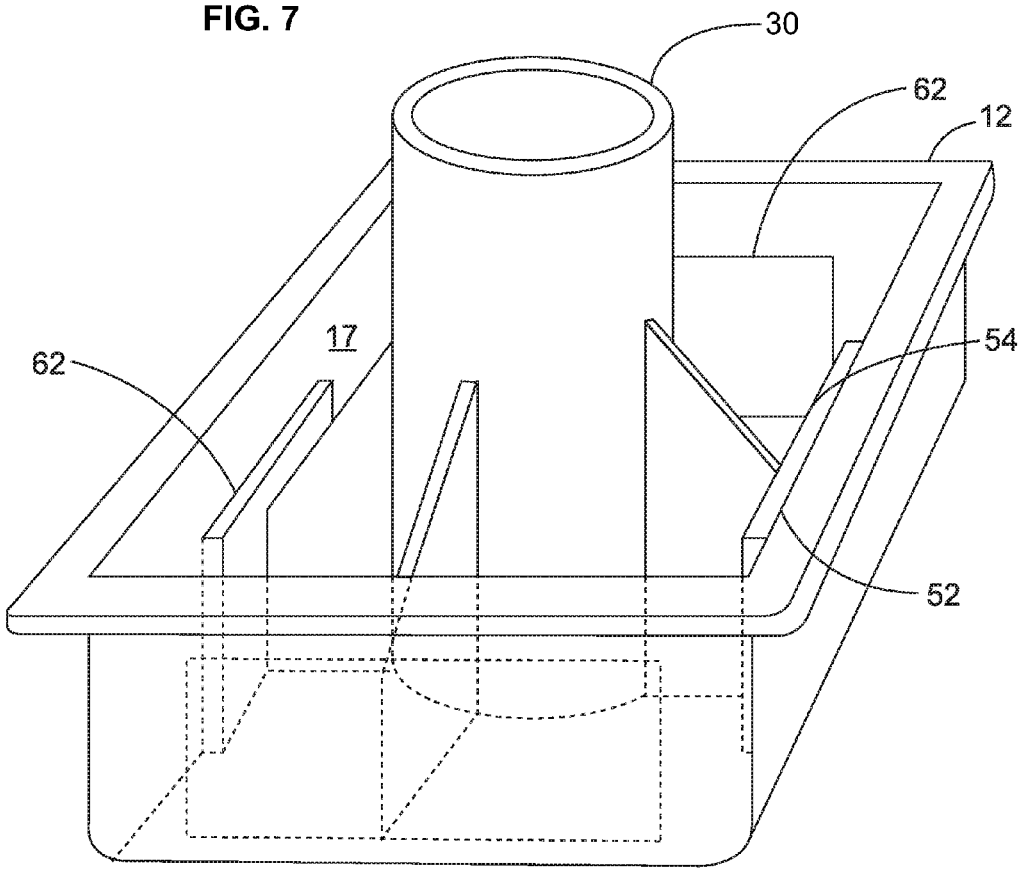
FIG. 8 is a perspective view of an alternate embodiment of a drop-in passive refrigeration canister inside a tray.

FIG. 8 is a perspective view of another embodiment of a canister 30 wherein ends 54 of the fins 52 are provided with plates 62, also referred to as gussets, which make contact with the side walls 17 of a temperature controlled tray 12. The fins 54 and plates/gussets 62 are sized to physically contact (make a physical connection with) walls 17 of the tray 12, which enables conductive heat transfer between the thermal canister 30 and the tray 12 as well as radiation between the fins and air inside the tray 12. As with the embodiments depicted in FIGS. 3-6, embodiments depicted in FIGS. 7 and 8 are also optionally provided with holes in the lower portions to facilitate air movement through the interior of the canister as well as an insulation layer as shown in FIG. 6. The holes and insulation layer are not shown in FIGS. 7 and 8 in the interest of clarity.

Figure 9:
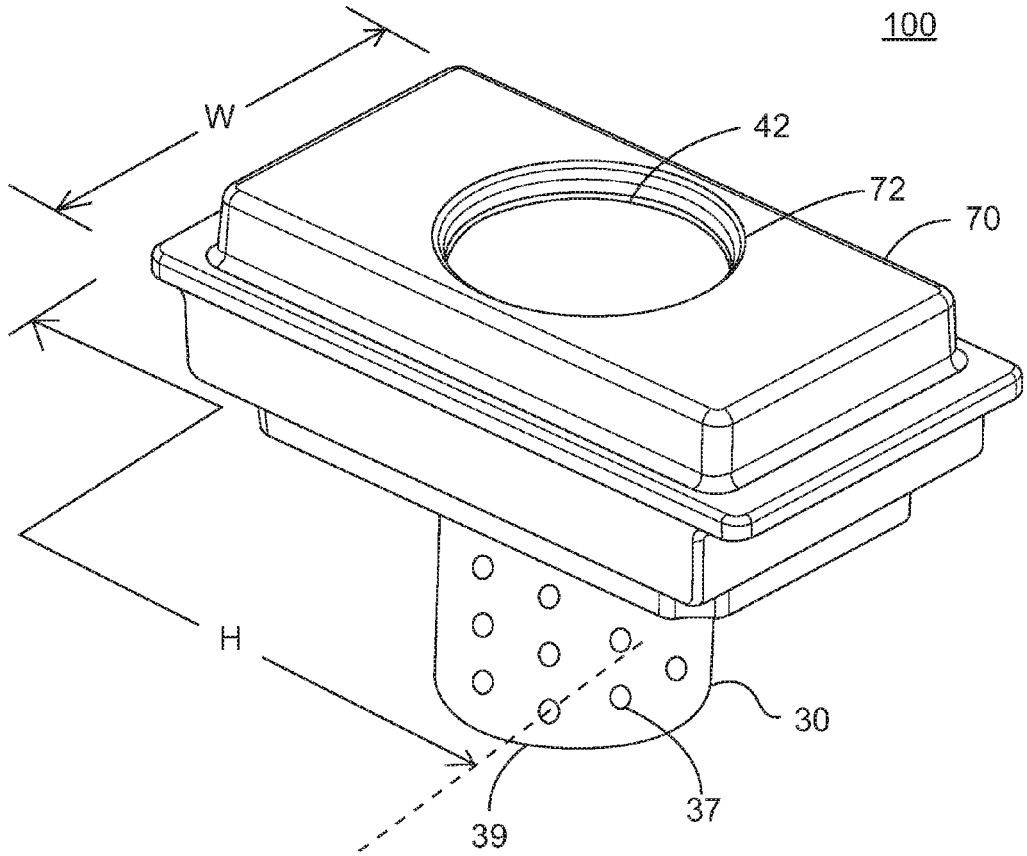
FIG. 9 is a perspective view of a preferred embodiment of a drop-in passive thermal insert canister provided with a cover that insulates upper portions of the tube and which also covers a tray.

The drop-in passive thermal insert embodiments described above illustrate the operation of structures that vertically extend temperature-controlled environments provided within a relatively shallow, temperature controlled food storage trays. As was set forth above, however, room air and convection currents can create temperature gradients with a tray 12 that can adversely affect the performance and operation of the embodiments set forth above. FIG. 9 therefore illustrates a perspective view of a preferred embodiment of a drop-in passive thermal insert canister 100 wherein a thermally-conductive canister 30 is provided with a collar 70 formed from a thermally insulating material having an exterior shape that will mate with and be received into an open top 16 of a food storage tray, not shown in FIG. 9.

The collar 70 shown in FIG. 9 is rectangular. It has a width W and a height H and side profiles (contours or shapes) selected so that the collar 70 fits over and/or just inside the open top of a rectangular food storage tray in order to keep ambient air out of the tray and to simultaneously provide insulation to surfaces of the canister 30 above the tray 12. While the embodiment shown in FIG. 9 is configured to mate with a rectangular tray, alternate embodiments of the collar 70 are configured to mate with any one of a square, round, oval, elliptical or irregular shape tray.

As can be seen in FIG. 9, the collar 70 is provided with a through hole 72 that receives a thermally-conductive canister 30, embodiments of which are described above and depicted in FIGS. 3-8. The fit between the surface of the hole 72 and the thermally-conductive canister 30 is a design choice. As with the canister embodiments 30 described above, holes 37 are also optionally provided in the lower portion of the canister 30, i.e., the portion of the canister 30 located below the bottom, lower surface of the insulative collar 70 (not shown in FIG. 9) so as to facilitate air movement between the interior of the tray and the interior of the canister.

Figure 10:
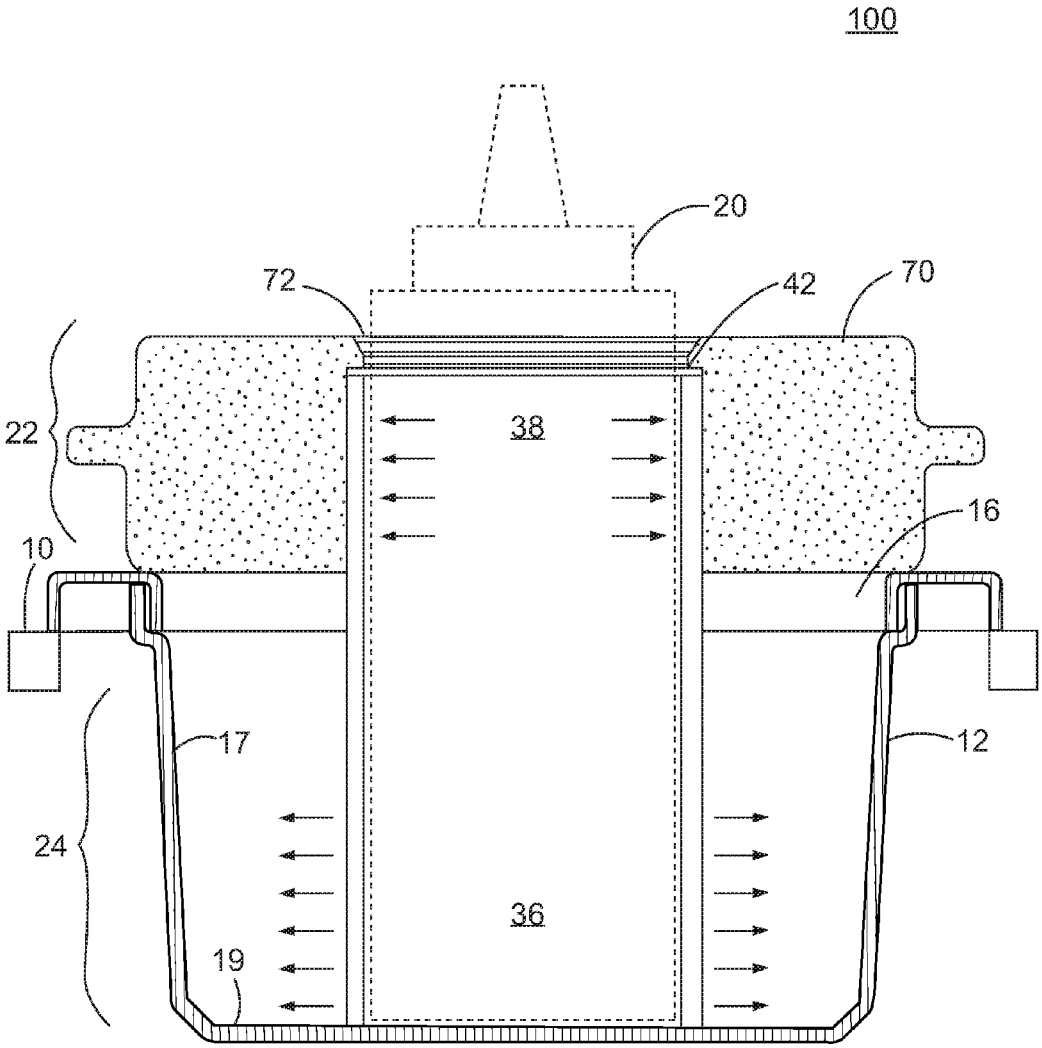
FIG. 10 is a cross section of the drop-in passive thermal insert canister inside a refrigerated food storage tray and depicting heat flow direction.

FIG. 10 is a cross sectional view of the embodiment depicted in FIG. 9. In FIG. 10, a temperature-controlled food storage tray 12 is installed into a food service counter 10. The canister 30, such as one of those depicted in FIGS. 3-8, extends through the collar 70, i.e., from one side of the collar, through the hole 72 to the opposite side of the collar 70. A condiment dispenser 20 is shown placed inside the canister 30, the height of which extends above the top of the canister 30 and above the top of the collar 70 so that the condiment dispenser 20 can be grasped for removal.

In FIGS. 9 and 10, the top 42 of the canister 30 is shown just below the top of the collar 70. In an alternate embodiment, the top 42 is perfectly flush or nearly flush with the top of the collar 70. Another alternate embodiment (not shown) uses a taller canister 30 that extends above the top, upper most surface of the collar 70 so as to project upwardly from the collar 70. Yet another embodiment uses a shorter canister that extends only part way through the collar 70 such that the top 42 of the canister 30 is below the top surface of the collar.

Arrows in FIG. 10 show the direction of heat flow in a refrigerated food storage tray. The direction of heat flow would be reversed in a heated food storage tray.

In FIG. 10, heat is radiated and/or conducted from the lower portion 36 of the canister 30 into the tray 12, causing the temperature of the lower portion 36 to decrease. Heat in the upper portion 38 is conducted from the upper portion 38 of the canister 30 to the lower portion 36 causing the temperature of the upper portion 38 to decrease. Heat radiated from the condiment dispenser 20 to the upper portion 38 or conducted from the upper portion of the dispenser 20 into the upper portion of the canister 30 is conducted down to the lower portion 36 where it is re-radiated into the tray 12. The insulating collar 70 substantially eliminates heat transfer between the canister 30 and ambient air. The insulating collar 70, which also covers the open top 16 of the tray 12, substantially eliminates heat transfer between the inside of the tray 12 and ambient air.

Figure 11:
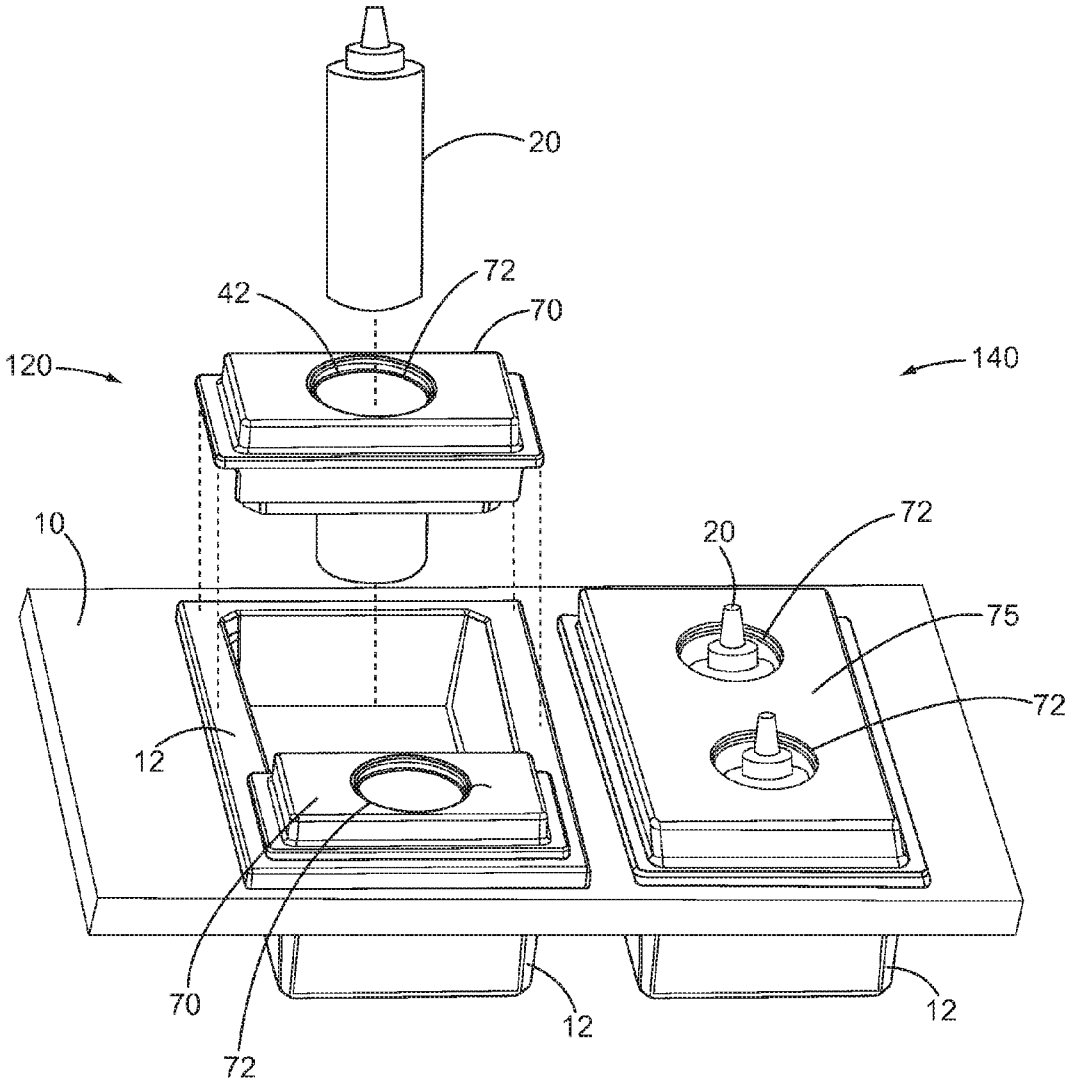
FIG. 11 includes an exploded view of a preferred embodiment of a drop-in passive thermal insert, showing the placement of a condiment dispenser and a configuration where two drop-in canister inserts are installed in a single tray and a drop-in canister insert having two passive refrigeration tubes and a single insulating cover.

FIG. 11 shows a drop-in passive thermal insert canister 30 with an insulating collar 70, which together form an assembly 120 configured to allow two such assemblies to fit within a single food storage tray 12. In FIG. 11, two drop-in passive thermal inserts are fitted to a single, rectangular insulating collar having two through-holes. In another embodiment also shown in FIG. 11, a single drop-in passive thermal insert is fitted with a square insulating collar that is configured to mate with a square food storage tray. The trays 12 with the drop-in passive thermal inserts are shown in FIG. 11, installed into a food service counter 10.

From a different perspective, FIG. 11 also shows an embodiment of a thermally-insulating collar 75, which is configured to substantially or completely cover a single tray 12 but which has two holes 72 to accept two, drop-in passive thermal insert canisters 30. The thermally-insulating collar 75 thus accepts a plurality of drop-in passive insert canisters 30 and provides a single, unified, thermally-insulating cover for a food storage tray having multiple holes for multiple canisters 30 and which minimizes or at least reduces heat transfer between the drop in canisters 30 and ambient room air.

Figure 12:
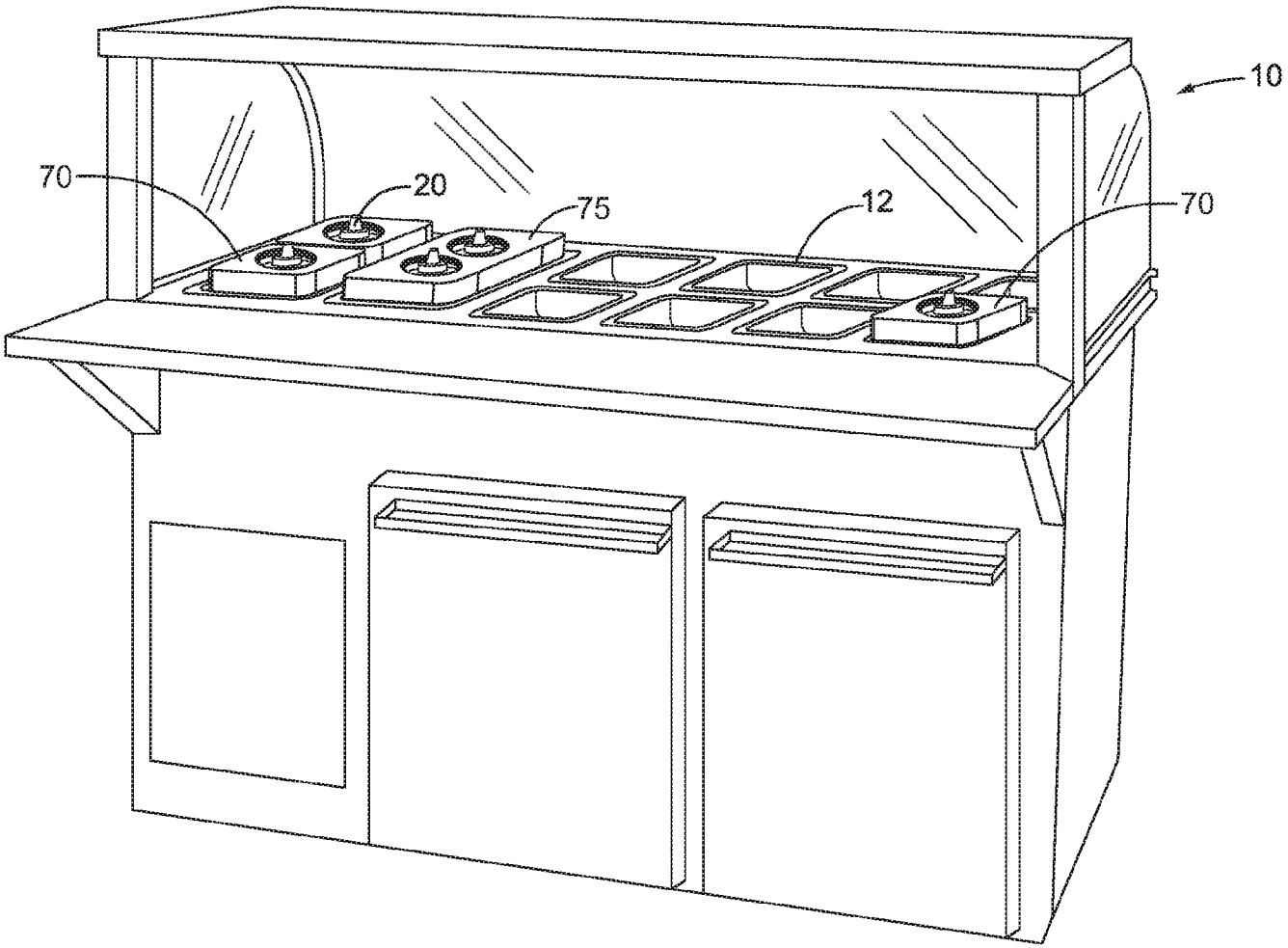
FIG. 12 depicts a food service counter with temperature controlled trays having drop-in passive thermal inserts.

As used herein, a drop-in passive thermal insert should be considered to include any thermally-conductive structure that can enclose a vessel taller than a temperature-controlled food storage tray and which exchanges heat between itself and the tray. Those of ordinary skill in the art will recognize that a drop-in passive insert, specifically including the drop in passive insert embodiments depicted in the figures and described above, can be advantageously used with a food service counter, as shown in FIG. 12. The temperature of hand-held dispensers 20 that need to be kept nearby but which might be too tall to be stood up right and kept at an appropriate temperature in a relatively shallow food storage tray can be kept handy and more appropriately cooled or heated in one or more trays 12 of the food service counter 10 using any one or more of the embodiments described above and depicted in the figures.

Figure 13:
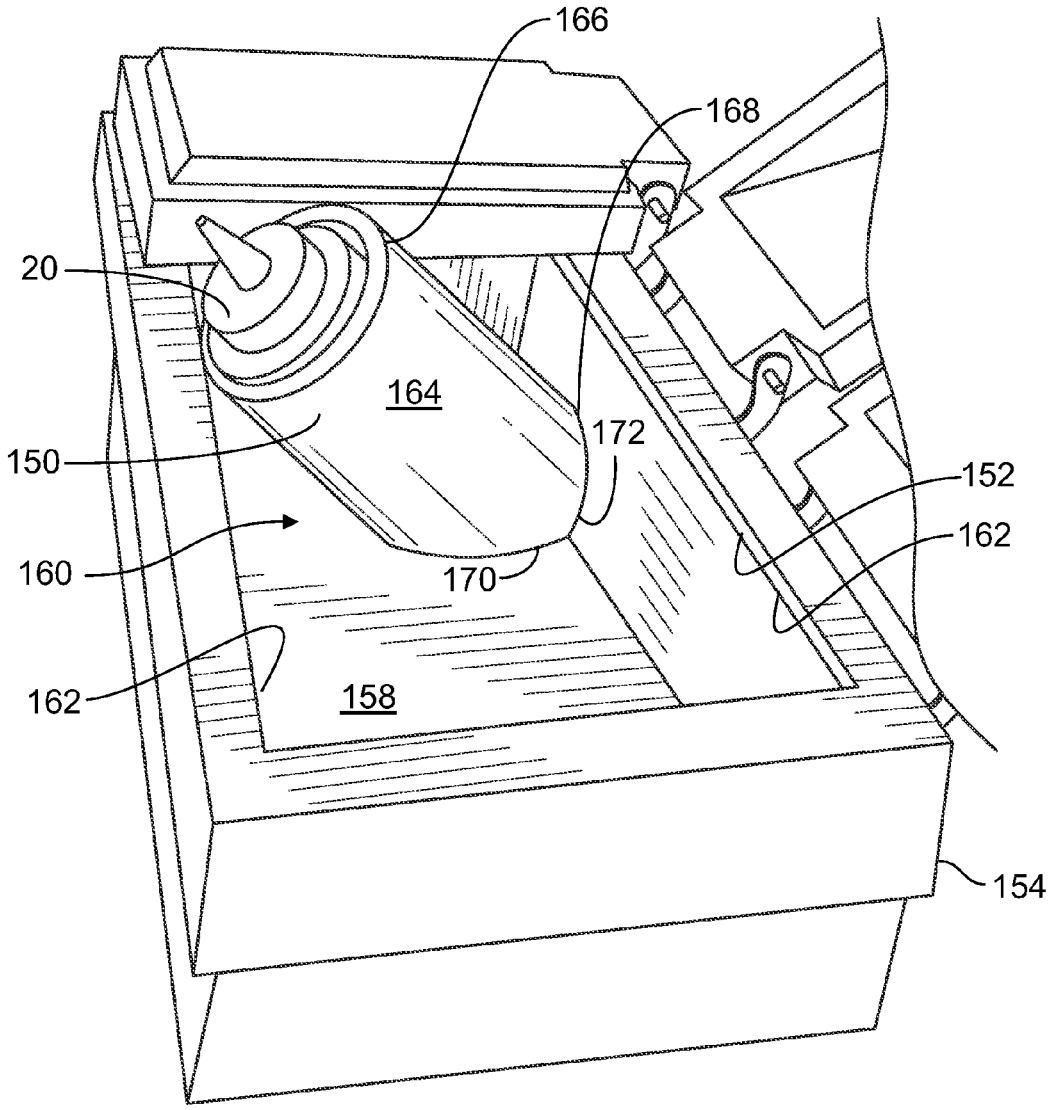
FIG. 13 is a perspective view of an alternate embodiment of a passive thermal insert in a temperature controlled tray.

FIG. 13 shows an embodiment of a drop-in passive thermal insert (insert), so called because the thermal insert can be placed into or dropped into place. As with the embodiments described above, the insert 150 is embodied as an elongated, hollow aluminum tube 164 having a length greater than the depth of a temperature-controlled food storage tray. Like the embodiments described above, the insert shown in FIG. 13 has a top end 166 and a bottom end 168. Unlike the embodiments described above, the elongated tube shown in FIG. 13 is inclined or canted. The bottom end 168 of the insert is formed to have two beveled edges or simply bevels, which are identified in FIG. 13 by reference numerals 170 and 172. The bevels 170 and 172 are themselves flat or planar, or shaped to conform to the temperature-controlled tray in order for the bevels to meet the surfaces of the tray and thereby maximize the surface area of the bevels 170 and 172 in direct thermal contact with surfaces of a temperature-controlled tray 152. The angle formed between the two bevels 170 and 172 is thus preferably equal to, or substantially equal to the angle between the bottom 158 and sidewall 162 of the tray 152 so that the two bevels 170 and 172 of the heat-conducting tube can be in direct thermal contact with the heat-conducting bottom 158 and sidewall 162. In one embodiment, the bevels 170 and 172 are at right angles to each other and rest against the orthogonal bottom and sidewalls of a temperature-controlled food serving tray 152.

Direct, mechanical and thermal contact of the first and second bevels 170 and 172 with the bottom 158 and sidewall 162 of a temperature-controlled tray 152 enables thermal energy to be conducted between the tube 164 to the tray 152. Thermal energy can thus be exchanged between the tube 164 and the tray 152 by radiation, convection currents flowing in the tray 152 and within the open volume inside the tube 164 and through conduction, i.e., heat energy is conducted through the surfaces formed by the bevels 170 and 172 in contact temperature-controlled surfaces of the tray 152.

An additional and significant advantage of the canted or inclined thermal insert 150 shown in FIGS. 13-19 is that when a food-dispensing vessel 20 is stored inside the inclined tube 164, an arcuate section of the side wall of the vessel 20 makes a direct physical, heat-transferring contact with a corresponding arcuate section of the interior side wall (not shown) of the tube 164. The direct contact of the sidewalls allows thermal energy to be conducted between the vessel 20 and the tube through the area of the vessel 20 in direct contact with the interior sidewall of the tube. Stated another way, improved heat transfer between the vessel 20 and the tube 150 is realized when the contact area between the vessel 20 and tube is increased.

The arc length of the sidewall of the vessel 20 that actually makes contact with the interior side wall of the inclined tube 164 will be a function of the inside diameter of the tube 164 and the outside diameter of the food-dispensing vessel 20. The arc length of the sidewall of the vessel 20 in direct contact the interior sidewall of the tube will thus be maximum, i.e., when the interior diameter of the tube 164 and the outside diameter of the vessel 20 are equal. Those of ordinary skill in the mechanical arts will recognize however that sizing the food dispensing vessel 20 outside diameter to match the inside diameter of the tube 164 would result in an interference fit between the vessel 20 and the tube, making it difficult to remove the vessel 20 from the tube. In a preferred embodiment, the tube 164 is embodied as an aluminum tube having an inside diameter of approximately two and one-half inches and a uniform tube wall thickness of between about one-eight inch and one-quarter inch. The food dispensing vessel has an outside diameter of approximately two inches.

Figure 14:
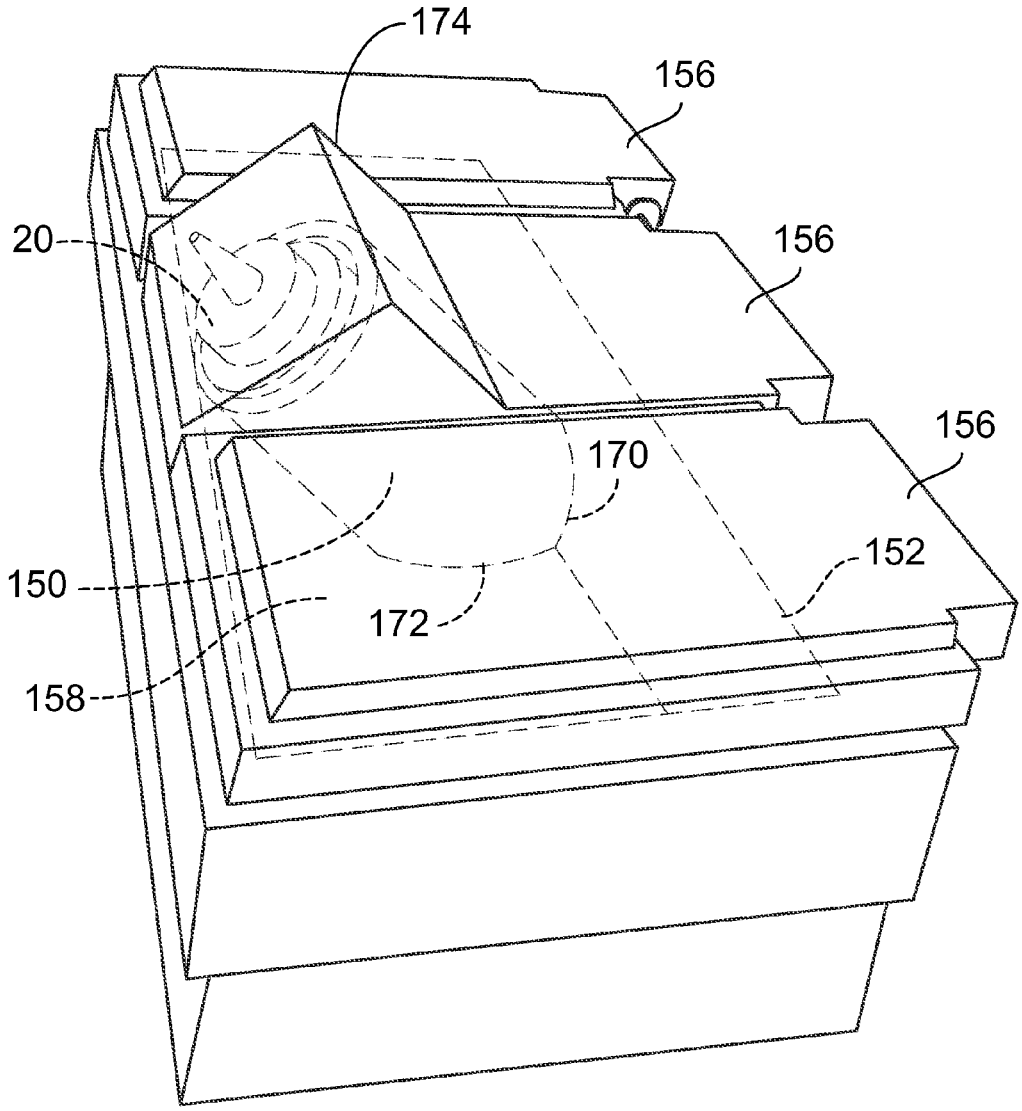
FIG. 14 shows the passive insert covered with a thermally-insulating cover that is hingedly attached to a counter-top refrigeration unit.

Thermal efficiency of the insert 150 can be significantly improved by covering the insert 150/tube 164 with an insulating cover when access to the food storage vessel 20 is not required. In FIG. 14, the temperature-controlled tray 152, which resides in a tabletop, stand-alone refrigeration unit 154, is provided with thermally insulated covers 156. Three such covers are shown in FIG. 14 due to the fact that the refrigeration unit 154 is long enough to accept three, industry-standard food holding trays, not shown in the figure. The covers 156 are hingedly attached to the tabletop/stand alone refrigeration unit 154 and swing upwardly, i.e., around a horizontal hinge pin. As can be seen in the figure, the center or middle cover 156 is provided with a hood 174, the interior of which is sized, shaped and arranged to fit over the portion of the tube 154 that extends over the open top 160 of the tray 152.

Figure 15:
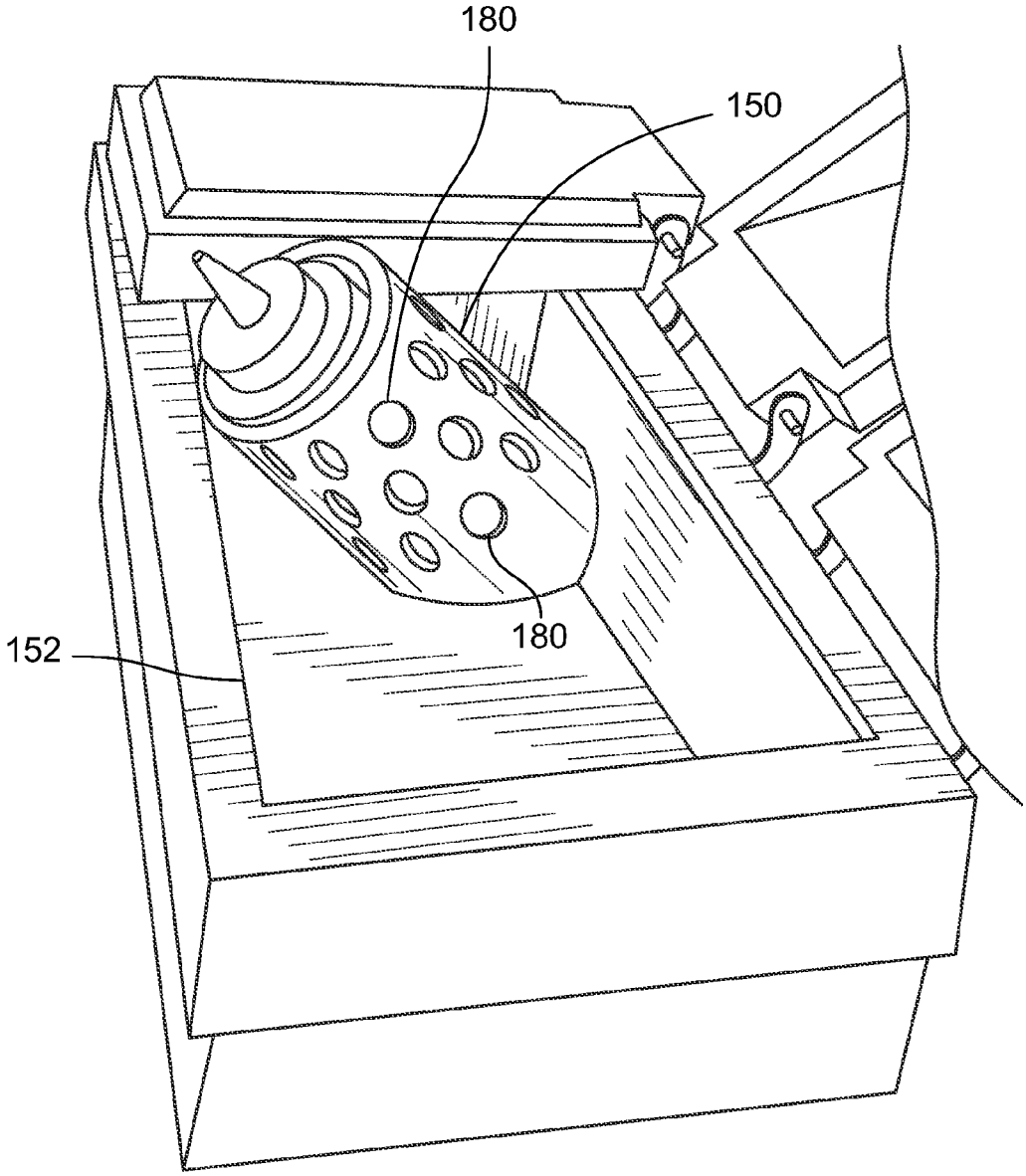
FIG. 15 shows another embodiment of a drop-in thermal insert.

FIG. 15 shows yet another embodiment of a drop-in thermal insert 151, similar to the one shown in FIG. 13 in that it has a bottom end with two bevels, however, the thermal insert 151 shown in FIG. 15 is provided with several air transfer holes 180. The air transfer holes 180 allow hot or cold air inside the temperature-controlled tray 152 to flow into and out of the interior volume of the insert 151, enhancing convective and radiation heat transfer.

Figure 16:
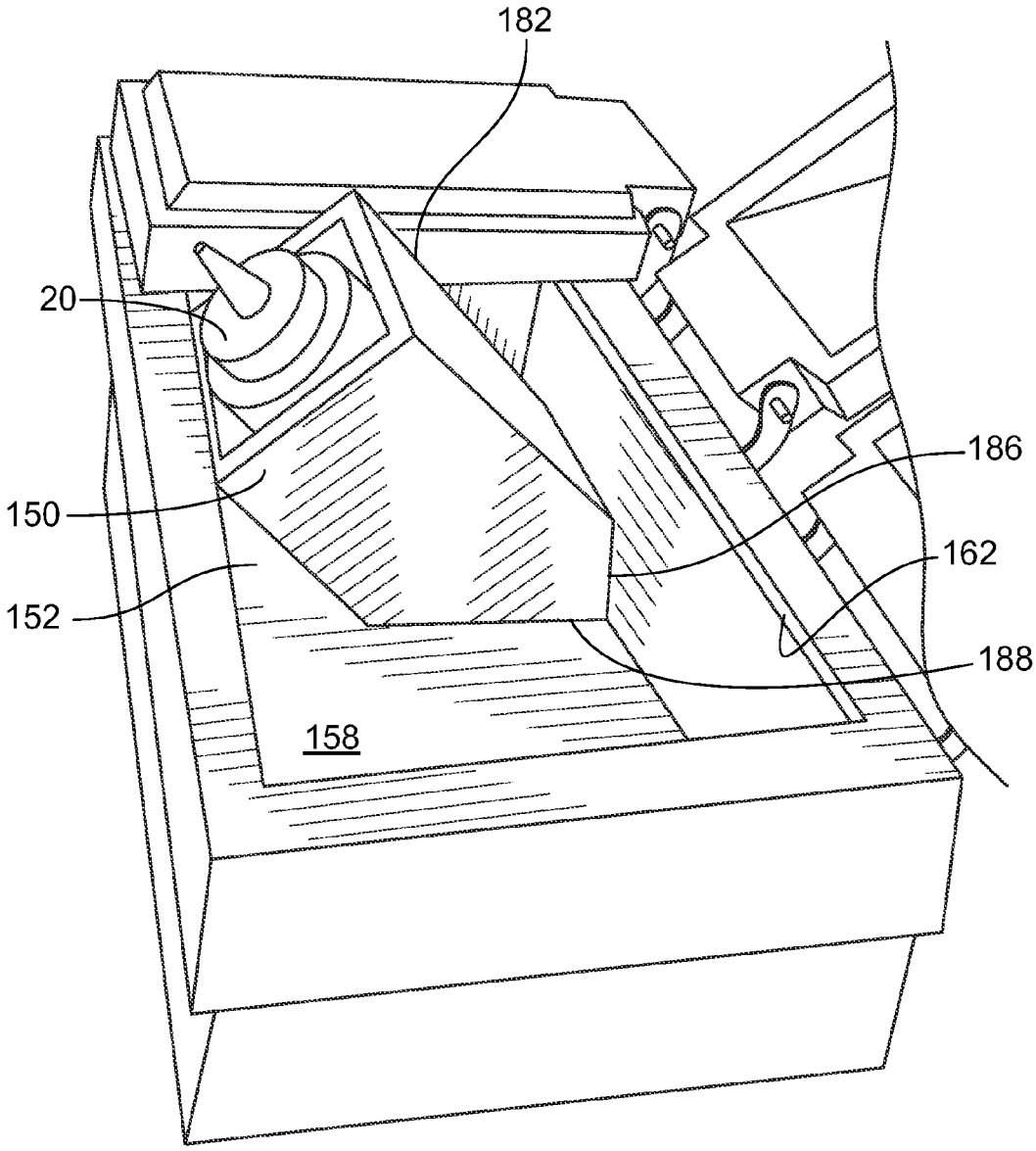
FIG. 16 shows a drop-in thermal insert having a square or rectangular cross section.

FIG. 16 shows yet another embodiment of a drop-in thermal insert 182 embodied as a square tube having four, equal-width square sides 184. As with the embodiment shown in FIGS. 13 and 15, the bottom end of the square tube 182 is provided with two bevels 186 and 187. The bottom bevel 188 is in direct thermal contact with the bottom 158 of the tray 152. The side or upright bevel 186 is in direct thermal contact with the side panel or side wall 162 of the tray 152. As with the embodiments shown in FIGS. 13-15, the angle between the two bevels 186 and 188 preferably matches the angle between the bottom 158 and side wall 162 of the tray.

While the embodiment shown in FIG. 16 depicts a square tube, alternate and equivalent embodiments include the use of a tube having a rectangular cross-section or a triangular cross-section as well as elliptical. As used herein, a tube having a non-circular cross section is a tube that can have a cross section that is either square, rectangular, triangular or elliptical Other alternate embodiments include tubes having circular and non-circular cross sections but which have bevels at the bottom ends that are both linear as well as non-linear. Stated another way, alternate embodiments have bevels formed into the bottom ends of the tubes that are curved. Curved "bevels" are preferably shaped to match the curvature of a non-planar sidewalls and a non-planar bottoms. The term "bevel" should therefore construed to include a straight or linear edge as well as a curved, non-linear edge.

Figure 17:
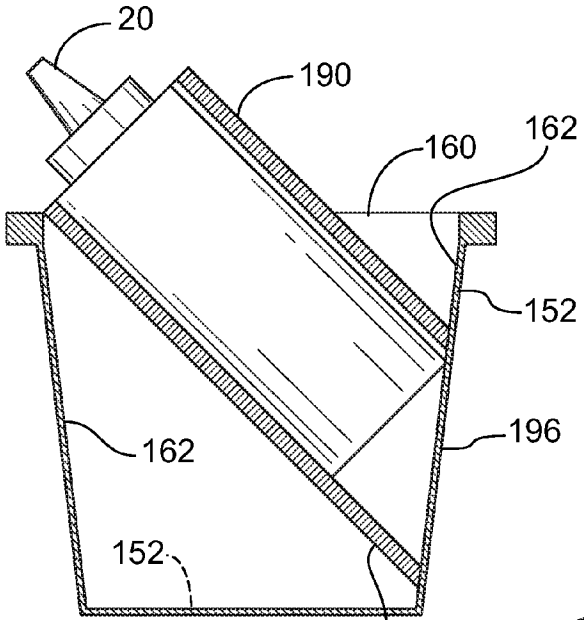
FIG. 17 is a cross-sectional view of another drop-in thermal insert with a bottom end having a single bevel.

FIG. 17 is a cross section of another embodiment of a drop-in thermal insert 190 is shown. In this embodiment, the insert 190 is circular or square in cross-section but has a bottom end 194 formed to have a single bevel 196. In the embodiment shown in FIG. 17, the single bevel 196 is linear and is in direct thermal contact with a planar or substantially planar side wall 162 of the temperature-controlled tray 152.

Figure 18:
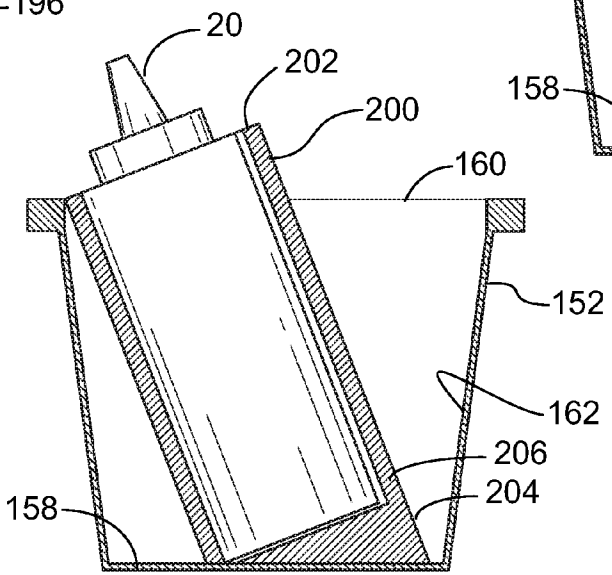
FIG. 18 is a cross-sectional view of an drop-in thermal insert having a bottom end that is closed.

FIG. 18 shows yet another embodiment of a thermal insert 200. In this figure, the insert 200 has a top end 202 that extends above the open top of the temperature-controlled tray 152, however, the insert 200 in FIG. 18 has a closed bottom end 204. The bottom end 204 is a solid block of material from which the insert 200 is formed but is formed to have a single bevel 206 the inclination angle of which matches the pitch or slope of the bottom of the tray. The solid bottom of the insert 200 provides a surface at the bottom to the insert 200 that is in direct thermal contact with the bottom surface of the food dispensing vessel 20. Both the bottom of the vessel 20 and an arc section of the side wall are therefore in thermal contact with the thermal insert.

Figure 19:
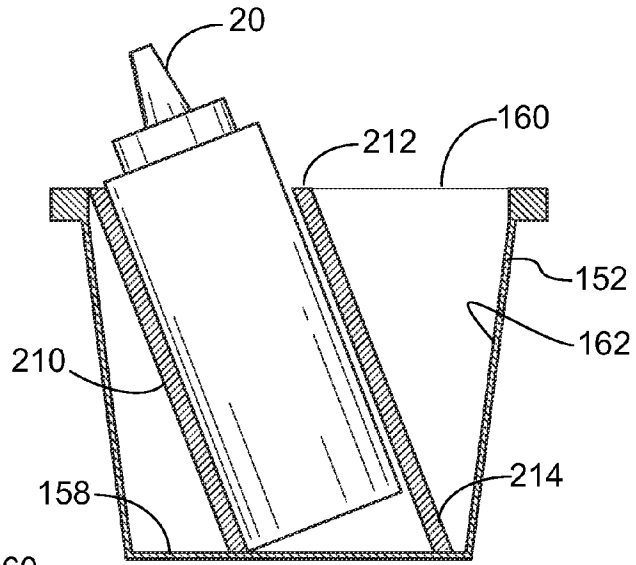
FIG. 19 is a cross-sectional view of a drop-in thermal insert having a bevel at the top end of the insert and at the bottom end of the insert.

Referring now to FIG. 19, another embodiment of a drop-in thermal insert 210 is shown having a top end 212 that is beveled and a bottom end 214 that is also beveled. Stated another way, the insert 210 shown in FIG. 19 is beveled at both the top and bottom end. Beveling the top end 212 of the insert 210 can make it easier for an operator to grasp a food dispensing vessel 20 however, removing heat-conductive material from around the vessel 20 will adversely affect the heat transfer between the tube and the vessel 20.

Those of ordinary skill in the art will recognize that the inserts shown in FIGS. 13-19 can optionally be formed with or without air transfer holes 180 as well as with or without closed bottom ends that provide a direct thermal contact between the bottom of a vessel 20 stored in the inserts.

Those of ordinary skill in the art will recognize that the thermal inserts can be used in both refrigerated trays and heated trays. Stated another way, the temperature-controlled tray 152 can be either a cold tray or a hot tray.

When the temperature-controlled tray is to be a cold tray, the tray 152 can be kept cold by a cold water bath, an ice/water slurry, crushed ice, one or more thermo-electric Piezo-electric devices, or a conventional refrigeration unit, none of which are shown in the figures for clarity but all of which are considered herein to be exemplars of a "refrigerated" tray. In embodiments where the temperature-controlled tray 152 is a hot or heated tray, heat energy can be provided to the tray 152 by steam, hot water bath, resistive electric heating elements or infrared lamps, not shown in the figures for clarity but which are considered herein to be exemplars of a "heated" tray.

In a preferred embodiment, the inserts/tubes are made from aluminum. Alternate embodiments use other heat-conductive materials that include but which are not limited to, copper, steel, stainless steel or combinations thereof.

Those of ordinary skill in the art will recognize that the inclined thermal insert shown in FIGS. 13-18 can be used with the temperature controlled trays 12 shown in FIGS. 3-10 as well as the temperature-controlled tray 152 shown in FIGS. 13-18. Since the thermal insert shown in FIGS. 13-18 can be used with the temperature controlled trays 12 shown in FIGS. 3-10, the thermal insert shown in FIGS. 13-18 also be used in a food serving counter, such as the food serving counter shown in FIGS. 11 and 12. Stated another way, the food service counters 10 shown in FIG. 12 can be comprised of any of the temperature-controlled trays 12 shown in FIGS. 3-10 and use in them, any one or more of the inclined or canted, drop-in inserts shown in FIGS. 13-19.

The foregoing description and the associated figures are for purposes of illustration. The invention is defined by the appurtenant claims.

The invention claimed is:

1. A thermal insert for providing temperature control to a vessel for dispensing food products, the thermal insert configured for use in a temperature-controlled tray having a bottom, an open top, and at least one side wall surface that extends between the open top and bottom, the temperature-controlled tray also having a depth substantially equal to the distance between the bottom and the open top, the thermal insert comprised of:

a thermally-conductive tube having a wall with a thickness, a length, an axis substantially parallel to the length of the thermally-conductive tube, and, a cross-section substantially orthogonal to the axis of the thermally-conductive tube, the thermally-conductive tube being configured to receive a vessel inside the thermally conductive tube, the thermally conductive tube having an open top end and a bottom end, the bottom end being beveled at an angle relative to the axis of the thermally-conductive tube such that at least a portion of the wall thickness is exposed along the bevel, the portion of the wall thickness that is exposed along the bevel being adapted to be in thermal communication with at least one of the side wall surface and the bottom of the temperature-controlled tray, the thermally-conductive tube cross-section, bevel, wall thickness and length being sized, shaped and arranged for facilitating conduction of thermal energy between a vessel inside the thermally-conductive tube and at least one of: a side wall surface of the temperature-controlled tray, and a bottom of the temperature-controlled tray.

2. The thermal insert of claim 1, further comprising:

a temperature-controlled tray having an open top, a side wall, a bottom and a depth, the depth being substantially equal to the distance between the open top and the bottom and being less than the length of the thermally-conductive tube, such that when the thermally-conductive tube is in the temperature-controlled tray and inclined relative to the sidewall of the temperature-controlled tray, a surface of the beveled end of the thermally-conductive tube contacts at least one of: the side wall and the bottom, of the temperature-controlled tray.

3. The thermal insert of claim 2, wherein the thermally-conductive tube and the temperature-controlled tray are metal and configured to transfer thermal energy between a vessel inside the thermally-conductive tube and the temperature-controlled tray, by way of conduction and radiation, thermal energy transfer between a vessel inside the thermally-conductive tube and the temperature-controlled tray being through the thermally-conductive tube.

4. The thermal insert of claim 2, wherein the thermally-conductive tube has a closed bottom end configured to contact at least one of: a sidewall and a bottom of the temperature-controlled tray, and is thereby configured to conduct heat between a vessel inside the thermally-conductive tube and the temperature-controlled tray.

5. The thermal insert of claim 2, wherein the temperature-controlled tray is a refrigerated tray.

6. The thermal insert of claim 5, wherein the thermally-conductive tube is configured to absorb heat radiated from a vessel inside the thermally-conductive tube and to re-radiate said absorbed heat from lower portions of the thermally-conductive tube that are located in the temperature-controlled tray and to also conduct said absorbed heat into the temperature-controlled tray through a surface of said at least one bevel that is in contact with at least one of: a sidewall and a bottom of the temperature-controlled tray.

7. The thermal insert of claim 2, wherein the temperature-controlled tray is a heated tray.

8. The thermal insert of claim 1, wherein the bevel at the bottom end of the thermally-conductive tube, is curved.

9. The thermal insert of claim 1, wherein the tube is aluminum.

10. The thermal insert of claim 1, wherein the tube is copper.

11. The thermal insert of claim 1, wherein the tube is steel.

12. The thermal insert of claim 1, wherein the thermally-conductive tube is perforated with a plurality of holes in a lower section of the thermally-conductive tube.

13. A temperature control device for a food-dispensing vessel having a first height, the temperature control device being comprised of:

a temperature-controlled tray having a bottom, and an open top, the temperature-controlled tray also having at least one side wall that extends between the open top and bottom, the temperature-controlled tray having a first depth between the open top and the bottom; and a thermally-conductive tube having an open top end, a bottom end, and a wall having a thickness, the thermally-conductive tube having a length and having a geometric axis substantially parallel to the length, the thermally-conductive tube also having an interior volume between the top and bottom ends and inside the wall, the interior volume of the thermally-conductive tube being configured to receive a food-dispensing vessel, said thermally-conductive tube having a length greater than the depth of the temperature-controlled tray but less than the height of the food-dispensing vessel, said bottom end being formed with at least one inclined portion, the inclined portion being across at least part of the tube at an angle relative to the geometric axis.

14. The temperature control device of claim 13, wherein the bottom end of the tube is formed with first and second bevels.

15. The temperature control device of claim 13, wherein the thermally-conductive tube has a lower portion provided with at least one air transfer hole.

16. The temperature control device of claim 14, wherein at least one of the first and second bevels is configured to contact a side wall of the temperature-controlled tray.

17. The temperature control device of claim 13, further including a temperature-controlled tray having an open top and configured to be installed into a food serving cabinet.

18. The temperature control device of claim 13, wherein the temperature-controlled tray is a refrigerated tray.

19. The temperature control device of claim 13, wherein the temperature-controlled tray is a heated tray.

20. A food service counter top comprised of:

a temperature-controlled tray having a depth and an open top;

a thermal insert located inside the temperature controlled tray, the thermal insert having an open top, a bottom, and a height greater than the depth of the temperature-controlled tray such that a portion of the thermal insert extends above the open top of the temperature-controlled tray, the thermal insert being configured to receive a food dispensing vessel having a height greater than the height of the thermal insert the bottom of the thermal insert being formed to have at least one beveled edge, the beveled edge being in thermal contact with a surface of the temperature-controlled tray.

21. The food service counter top of claim 20, further comprised of a thermally-insulating cover for said temperature-controlled tray, said cover configured to insulate at least a portion of the thermal insert above the open top of the temperature-controlled tray.

22. The food service counter top of claim 20, wherein the thermal insert is comprised of a thermally-conductive tube.

23. The food service counter top of claim 22, further comprised of a food dispensing vessel configured to be fit into the thermal insert.

24. The food service counter top of claim 20, wherein the temperature-controlled tray is refrigerated.

25. The food service counter top of claim 20, wherein the temperature-controlled tray is heated.

* * * * *